US010639920B2

(12) United States Patent
Miikki

(10) Patent No.: US 10,639,920 B2
(45) Date of Patent: May 5, 2020

(54) PRINTING PAPER WITHOUT INK

(71) Applicant: Stora Enso OYJ, Helsinki (FI)

(72) Inventor: Nina Miikki, Imatra (FI)

(73) Assignee: Stora Enso OYJ, Helsinki (FI)

( * ) Notice: Subject to any disclaimer, the term of this patent is extended or adjusted under 35 U.S.C. 154(b) by 71 days.

(21) Appl. No.: 15/762,141

(22) PCT Filed: Sep. 23, 2016

(86) PCT No.: PCT/IB2016/055698
§ 371 (c)(1),
(2) Date: Mar. 22, 2018

(87) PCT Pub. No.: WO2017/051368
PCT Pub. Date: Mar. 30, 2017

(65) Prior Publication Data

US 2018/0281493 A1 Oct. 4, 2018

(30) Foreign Application Priority Data

Sep. 23, 2015 (SE) ..... 1551225

(51) Int. Cl.
*D21F 11/00* (2006.01)
*D21H 11/18* (2006.01)
(Continued)

(52) U.S. Cl.
CPC ..... *B41M 5/0035* (2013.01); *B41M 3/10* (2013.01); *B41M 5/26* (2013.01); *D21F 11/006* (2013.01);
(Continued)

(58) Field of Classification Search
CPC ..... D21F 1/44; D21F 11/006; D21F 11/14; D21H 11/18; D21H 21/40; D21H 25/04;
(Continued)

(56) References Cited

U.S. PATENT DOCUMENTS

2010/0151159 A1* 6/2010 Beck ..... B82Y 20/00 428/30
2011/0081554 A1* 4/2011 Ankerfors ..... C09D 101/02 428/535

(Continued)

FOREIGN PATENT DOCUMENTS

DE 3431577 * 3/1986
DE 19822605 * 11/1999

(Continued)

OTHER PUBLICATIONS

Henriksson, M et al., "Cellulose nanopaper structures of high toughness," Fibre and Polymer Technology, Royal Institute of Technology, Stockholm, SE, Mar. 13, 2008.
International Search Report for PCT/IB2016/055698, dated Nov. 17, 2016.

*Primary Examiner* — Eric Hug
(74) *Attorney, Agent, or Firm* — Greer, Burns & Crain Ltd.

(57) ABSTRACT

A method for printing a wet web material comprising microfibrillated cellulose, wherein said method comprises the steps of providing an aqueous suspension comprising microfibrillated cellulose; applying said aqueous suspension to a substrate, thus forming a wet web having a moisture content in the range of 5 to 70 weight-%; wherein the method further comprises the step of treating said wet web by heating at least one well-defined portion thereof, whereby the web is provided with a print at the at least one heated portion.

14 Claims, 1 Drawing Sheet

(51) Int. Cl.

| | |
|---|---|
| ***D21H 21/40*** | (2006.01) |
| ***D21H 25/04*** | (2006.01) |
| ***B41M 5/00*** | (2006.01) |
| ***B41M 5/26*** | (2006.01) |
| ***B41M 3/10*** | (2006.01) |

(52) U.S. Cl.
CPC ..... *D21H 11/18* (2013.01); *D21H 21/40* (2013.01); *D21H 25/04* (2013.01)

(58) Field of Classification Search
CPC ..... D21H 25/06; B41M 5/0035; B41M 5/26; B41M 3/10
USPC ..... 162/146, 157.6
See application file for complete search history.

(56) References Cited

U.S. PATENT DOCUMENTS

| | | | | |
|---|---|---|---|---|
| 2015/0140237 | A1 | 5/2015 | Schmidt | |
| 2015/0191036 | A1* | 7/2015 | Ratnakumar ..... | D21H 27/00 162/140 |

FOREIGN PATENT DOCUMENTS

| | | | |
|---|---|---|---|
| WO | 200712284 | | 2/2007 |
| WO | WO 2007/122284 | * | 11/2007 |
| WO | 2009123560 | A1 | 10/2009 |
| WO | 2014091413 | A1 | 6/2014 |

* cited by examiner

PRINTING PAPER WITHOUT INK

This application is a U.S. National Stage under 35 U.S.C. § 371 of International Application No. PCT/IB2016/055698, filed Sep. 23, 2016, which claims priority to Swedish Patent application no. 1551225-4, filed Sep. 23, 2015.

TECHNICAL FIELD

The present document relates to a process for printing a wet laid web comprising a fibrous material.

BACKGROUND

Exclusive paper products are often given a luxury appearance through printing. The print promotes the product and creates an image of the product to the customer.

However, printing is done as a separate process which is expensive. Further, printing inks can never be used on products which are in direct contact with food, or liquids, as the ink might migrate into the food or liquid product. Also, in hygienic products a direct contact from the printing to the skin needs to prevented, for instance are hygienic products like wet wipes, dressings and pads, never printed with printing inks etc. One such product is shown in SE537517C2 where a wet laid web, or a so called wet or moist tissue, comprising microfibrillated cellulose, is produced. That type of product would for instance not be printable, as is still substantially wet, or moist, when it is packaged and delivered to customers, i.e. it is not dried enough to be printable with ink, and as it is in some applications meant to be used as a hygienic wet wipe, a printing ink could cause skin irritations etc. Another example of such a product and process for producing the product is described in WO2015004324A1, where a water soluble biobased film is produced. Another method of providing paper products with a print, or an imprint is to punch holes or make an imprint into the material. Even though this type of process can be made in a conventional paper making machine, it is not always suitable. The holes or imprints may for instance cause the product to be prone to ripping etc., which is not desirable in a high speed production process.

There is thus a need for a process in which products can be provided with a print, without using printing inks or other types of colorants, for instance for identification and differentiation of the product before the customer or end user. Further there is a need for a printing process which can be fully incorporated into a wet laid process, or into a conventional paper or paperboard making process.

SUMMARY

It is an object of the present disclosure, to provide an improved printing process for products where conventional printing methods using print inks or other colorants are not suitable.

More specific objects include providing a printing process for wet laid webs and sheets comprising microfibrillated cellulose.

The object is wholly or partially achieved by a method according to the appended independent claims. Embodiments are set forth in the appended dependent claims, and in the following description and drawings.

According to a first aspect, there is provided a method for printing a wet web material comprising microfibrillated cellulose, wherein said method comprises the steps of providing an aqueous suspension comprising microfibrillated cellulose; applying said aqueous suspension to a substrate, thus forming a wet web having a moisture content in the range of 5 to 70 weight-% and wherein said wet web is treated by heating at least one well-defined portion thereof, whereby the web is provided with a print at the at least one heated portion.

Without being bound to any theory, it is believed that the added heat causes moist and water to very quickly evaporate. This in turn leads to a morphology or texture change in the microfibrillated cellulose fibrills and between the fibrils and the web/film, respectively. The change in morphology occurs both on 2D and 3D level, which in turns affects the light scattering and optical properties. Furthermore, the fibrils of the treated surface, might consolidate and/or hornificate which also leads to different response and interaction with water or moisture leading to patterns in the web to be formed. The heating is thus performed on the wet laid web when it is still substantially wet or moist.

Through this inventive method it is thereby possible to introduce images and/or printing directly in the web, without using printing inks, or punching holes in the web. The method creates a clearly visible print in or on the product, but does not generate any problems with tearing or ripping. This method is also suitable for creating a print on a material which is never dried, such as for instance a wet laid hygienic wet wipe which may also be a so called highly sensitive product.

Further as this "printing" is done typically to very wet material before drying, this is extremely difficult to counterfeit, i.e. this may be a way of safe proofing materials against counterfeiting.

The "printed" areas can be made more porous, which means that permeability properties can be adjusted, it may for instance be possible to adjust the oxygen transmission rate (OTR), the water vapor transmission rate (WVTR) or the passage of for example aroma or perfume in a controlled way etc. This could also be a way of controlling the flow of liquids through the material, which could be applicable in for instance napkins etc.

The substrate may be a porous wire in a paper making machine. The paper making machine can be any conventional type of machine with a wire used for the production of paper, paperboard, tissue or non-woven products known to the skilled person.

The substrate may also be a paper or paperboard substrate thus forming a paperboard or paper substrate coated with a MFC film. The substrate may also be a polymer or metal substrate. The casted fibrous web can then be printed and thereafter dried in any conventional manner and thereafter peeled off from the substrate. According to one embodiment the method may further comprise the step of de-watering or drying the web.

However drying is not a requirement, since the markings or print can be easily seen also in a wet or substantially wet product, such as a wet wipe.

The dried web preferably has a basis weight below 60 gsm, preferably below 40 gsm, preferably between 2-40 gsm, preferably between 10-35 gsm.

The dried web preferably has a density in the range of 400-1500 kg/m$^3$, preferably between 700 to 1400 g/m$^3$.

It is preferred that the printed web is a translucent, thin film with high density comprising high amounts of microfibrillated cellulose. It was surprising that it was possible to provide such a web with a visible print by heating.

According to one embodiment the well-defined portion or portions comprises any one of a figure and a letter, or a combination thereof.

By "a well defined portion" is thus meant the portion of the web that creates or forms the print itself. This could be for instance a logotype, a pattern or letters, where the letters may form words or sentences.

According to one embodiment of the first aspect the heating may be performed by using laser.

This means that the material is laser treated, i.e. not that it is laser printed, which involves the use of a dry ink toner. The inventive method is thus completely free from the use of printing inks. This means the expression "by using laser" is meant that the laser beam, of a suitable strength, is used directly towards the wet web material, i.e. directly hits the web.

The suspension preferably comprises microfibrillated cellulose in an amount of 60-100 wt-% based on total dry solid content, preferably between 70-99.9 wt-% based on total dry solid content. It was surprising that it was possible to treat a web comprising high amounts of MFC with heat and in this way be able to provide the web with a print. A web comprising high amounts of MFC is very dense and it was not expected that the fibrils of the web would be able to swell without destroying the web.

According to one embodiment the moisture content in the wet web may be in the range of from 10 to 60 weight-%, or from 20 to 50 weight-%, or from 25 to 45 weight-%.

Thus, the moisture content of the web can vary and the moisture needs not only be based on water, in a wet wipe the moisture content may comprise alcohol etc. It is however essential that the web is substantially moist, i.e. comprises a liquid, because it is not possible to create prints by heat on a dry web, for instance at a dry content of 95 weight-% a laser beam would cut the web, instead of creating the desired effect of a printed pattern through the swelling of the fibrous material.

According to one embodiment the step of heating may be performed in an in-line process step.

According to an alternative embodiment the step of heating may be performed in an off-line process step.

According to one embodiment the method may further comprise a step of treating the surface of the web and/or coating the web.

By "treating the surface" is meant that the web may be surface sized, or coated etc.

According to a second aspect there is provided a paper or paper product, comprising a fibrous material, obtainable by the method according to the first aspect.

By paper product is thus meant any type of product formed from a fibrous web. It may thus be a paperboard, a wet tissue, a film or any other type of fiber based product. The product may be a so called highly sensitive product with no added materials. The surface of the dried material both feels and looks good and can thus be applied in so called luxury paper products. As no ink is used, the material can easily be re-pulped, without having to de-ink the material. It may thus be very well suitable in an in-line process where the waste material is re-used directly.

According to one embodiment the product may be a tissue product.

According to another embodiment of the second aspect the paper, paper product or tissue product may be any one of a woven and a nonwoven product. Examples may be napkins, towels, sanitary pads, dressings etc.

BRIEF DESCRIPTION OF THE DRAWINGS

Embodiments of the present solution will now be described, by way of example, with reference to the accompanying schematic drawings.

DESCRIPTION OF EMBODIMENTS

Figure 1:
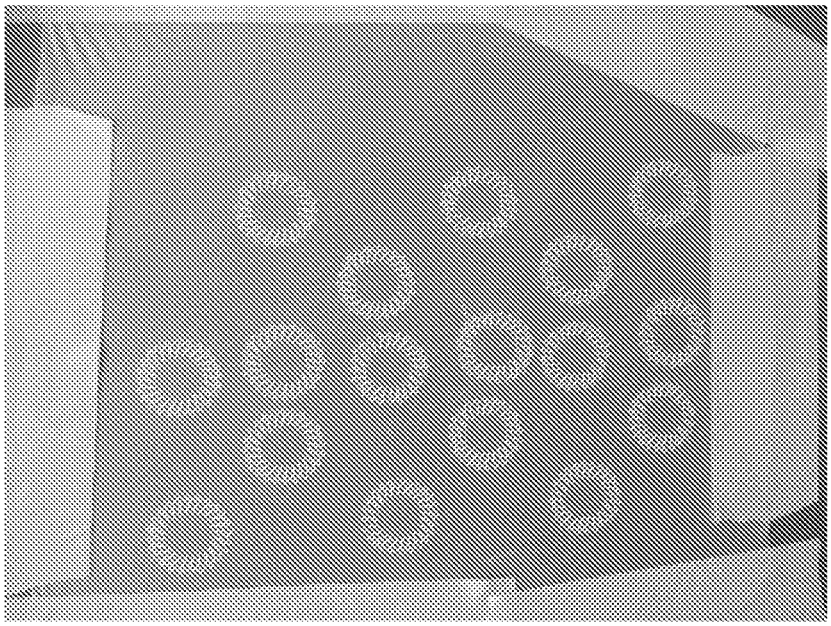
FIG. 1 is a photograph of a laser printed images in a dried material.

According to the invention a method for printing a wet web material comprising microfibrillated cellulose is provided.

The method comprises the steps of applying an aqueous suspension comprising microfibrillated cellulose and applying said aqueous suspension to a substrate, thus forming a wet web having a moisture content in the range of 5 to 70 weight-%. The wet web is then treated by heating well defined portions of the web.

The heating of the web causes the microfibrillated cellulose in the wet web to swell, and by using a heating method that impacts, i.e. heats up, only very well defined portions of the web, a pattern or a "print" can be achieved. This means that the heated portions may have an increased profile as seen in a side view (z-direction of the web) than the un-heated parts of the wet web, thus also providing the web with a specific touch feeling.

The inventive method thus allows for a very well-defined pattern to be printed on the wet web, without using any types of ink or other means of coloring the web.

The print may be done on and/or in the web. The printing may be done locally on the surface of the web or be incorporated into the web, i.e. also be in the web.

The heating method may be any suitable type of heating for providing a well-defined or local print on the web. According to one embodiment the heat is provided by a hot surface, e.g. a calender. According to an alternative the heating is performed by hot air, for instance blown at the web by a pressurized air nozzle.

According to another embodiment the heating is performed by using a laser or a laser beam. The laser beam thus impacts the wet web directly and creates the print or pattern on the web. The strength, or level, of the laser beam may be adjusted to give the desired effect in the wet web.

A film or web formed from microfibrillated cellulose is strong and it is difficult to tear the web, especially if the web is wet. With low laser energy or high moisture content the laser will not cut the fibers and in the printed area there is hardly any change in tearing. With a low moisture content or high laser energy the laser may cut some of the top fibers. It may thus be possible to also cause pinholes or cuts with the laser. This partial cutting of the web may be used to provide a "tear line" or "opening line", for instance in packages, in connection with the printed area, i.e. both a print and a cutting line may be provided in the web.

The printing means may be digital (variable) or analogue.

The print or pattern may be any type of shape or form. According to one embodiment the print comprises a letter or a series of letters, or even Braille letters. According to one embodiment the print comprises a figurative pattern, such as for instance a logotype or a graphic design. The printing may thus be a marking or purely decorative.

The moisture content of the wet web may be varied, depending on the starting materials, and the desired end product. It is essential that the moisture content is sufficient to allow for the heat treatment to cause the microfibrillated cellulose to swell in such a way that the print becomes visible. This means that the moisture content preferably is above 5 weight-%, but it may be in the range of 5 to 80 weight-%. Alternatively the moisture content is in a range from 10 to 60 weight-%, or from 20 to 50 weight-%, or from 25 to 45 weight-%.

If the invention is done in-line it is possible to incorporate it into a conventional paper or paperboard making process. According to one embodiment the web is produced in a wet laid process.

According to one embodiment the method may further comprise a step of treating the surface of the web and/or coating the web.

By "treating the surface" is meant that the web may be surface sized, or coated etc. By surface sizing is meant contact coating methods used in paper and paperboard industry. Those are e.g. film press, surface sizing (pound or flooded nip size press), gate roll, Gate roll Inverted coater, Twin HSM applicator, Liquid application system, blade/roll metering with the Bill blade, TwoStream, Blade/Blade metering with the mirrorBlade, VACPLY, or application and metering with a nozzle unit onto paper web (Chapt. 14, Coating and surface sizing technologies, Linnonmaa, J., and Trefz, M., in Pigment coating and surface sizing of paper, Papermaking Science and Technology, Book 11, $2^{nd}$ Ed., 2009). In addition, reverse gravure or gravure methods, sizing based on indirect metering onto roll using e.g. spray, spinning or foam deposition may also be included in this definition. Other variations and modifications or combinations of the coating methods, obvious for a person skilled in the art, are also included herein.

According to one embodiment the wet web may be de-watered or dried subsequent to the heat treatment, to provide a dry or substantially dry paper product. According to one embodiment the wet web may also be laminated, to e.g. a fibrous sheet or film, such as a paper or paperboard, or to a thermoplastic polymer sheet or film.

The web may also be coated with any conventional coatings, such as dispersion coating or other transparent or semitransparent coatings.

The product formed through the process may be any type of paper or paperboard product. According to one embodiment the product may be a tissue product. According to one embodiment the product is a woven product. According to another embodiment the product is a non-woven product.

According to one alternative the product may be a never dried wet web, for instance a wet wipe formed from a web comprising mainly microfibrillated cellulose.

Microfibrillated cellulose (MFC) shall in the context of the patent application mean a nano scale cellulose particle fiber or fibril with at least one dimension less than 100 nm. MFC comprises partly or totally fibrillated cellulose or lignocellulose fibers. The liberated fibrils have a diameter less than 100 nm, whereas the actual fibril diameter or particle size distribution and/or aspect ratio (length/width) depends on the source and the manufacturing methods. The smallest fibril is called elementary fibril and has a diameter of approximately 2-4 nm (see e.g. Chinga-Carrasco, G., *Cellulose fibres, nanofibrils and microfibrils: The morphological sequence of MFC components from a plant physiology and fibre technology point of view, Nanoscale research letters* 2011, 6:417), while it is common that the aggregated form of the elementary fibrils, also defined as microfibril (Fengel, D., *Ultrastructural behavior of cell wall polysaccharides*, Tappi J., March 1970, Vol 53, No. 3.), is the main product that is obtained when making MFC e.g. by using an extended refining process or pressure-drop disintegration process. Depending on the source and the manufacturing process, the length of the fibrils can vary from around 1 to more than 10 micrometers. A coarse MFC grade might contain a substantial fraction of fibrillated fibers, i.e. protruding fibrils from the tracheid (cellulose fiber), and with a certain amount of fibrils liberated from the tracheid (cellulose fiber).

There are different acronyms for MFC such as cellulose microfibrils, fibrillated cellulose, nanofibrillated cellulose, fibril aggregates, nanoscale cellulose fibrils, cellulose nanofibers, cellulose nanofibrils, cellulose microfibers, cellulose fibrils, microfibrillar cellulose, microfibril aggregrates and cellulose microfibril aggregates. MFC can also be characterized by various physical or physical-chemical properties such as large surface area or its ability to form a gel-like material at low solids (1-5 wt %) when dispersed in water. The cellulose fiber is preferably fibrillated to such an extent that the final specific surface area of the formed MFC is from about 1 to about 200 m2/g, or more preferably 50-200 m2/g when determined for a freeze-dried material with the BET method.

Various methods exist to make MFC, such as single or multiple pass refining, pre-hydrolysis followed by refining or high shear disintegration or liberation of fibrils. One or several pre-treatment step is usually required in order to make MFC manufacturing both energy efficient and sustainable. The cellulose fibers of the pulp to be supplied may thus be pre-treated enzymatically or chemically, for example to hydrolyse or swell fiber or reduce the quantity of hemicellulose or lignin. The cellulose fibers may be chemically modified before fibrillation, wherein the cellulose molecules contain functional groups other (or more) than found in the original cellulose. Such groups include, among others, carboxymethyl (CMC), aldehyde and/or carboxyl groups (cellulose obtained by N-oxyl mediated oxydation, for example "TEMPO"), or quaternary ammonium (cationic cellulose). After being modified or oxidized in one of the above-described methods, it is easier to disintegrate the fibers into MFC or nanofibrillar size or NFC.

The nanofibrillar cellulose may contain some hemicelluloses; the amount is dependent on the plant source. Mechanical disintegration of the pre-treated fibers, e.g. hydrolysed, pre-swelled, or oxidized cellulose raw material is carried out with suitable equipment such as a refiner, grinder, homogenizer, colloider, friction grinder, ultrasound sonicator, fluidizer such as microfluidizer, macrofluidizer or fluidizer-type homogenizer. Depending on the MFC manufacturing method, the product might also contain fines, or nanocrystalline cellulose or e.g. other chemicals present in wood fibers or in papermaking process. The product might also contain various amounts of micron size fiber particles that have not been efficiently fibrillated. MFC is produced from wood cellulose fibers, both from hardwood or softwood fibers. It can also be made from microbial sources, agricultural fibers such as wheat straw pulp, bamboo, bagasse, or other non-wood fiber sources. It is preferably made from pulp including pulp from virgin fiber, e.g. mechanical, chemical and/or thermomechanical pulps. It can also be made from broke or recycled paper.

The above described definition of MFC includes, but is not limited to, the new proposed TAPPI standard W13021 on cellulose nanofibril (CNF) defining a cellulose nanofiber material containing multiple elementary fibrils with both crystalline and amorphous regions, having a high aspect ratio with width of 5-30 nm and aspect ratio usually greater than 50.

Example

A sheet, i.e. a wet wipe, was prepared in accordance with the method disclosed in SE537517 C2. This wet laid sheet comprising microfibrillated cellulose (MFC), was heat treated, i.e. printed, with a laser and the sheet was subsequently dried under tension after the laser printing. In FIG. 1 the sheet is depicted with a figurative print when is drying. The print can be clearly seen where the sheet was subjected to heating by the laser as well defined portions on the sheet.

Figure 2:
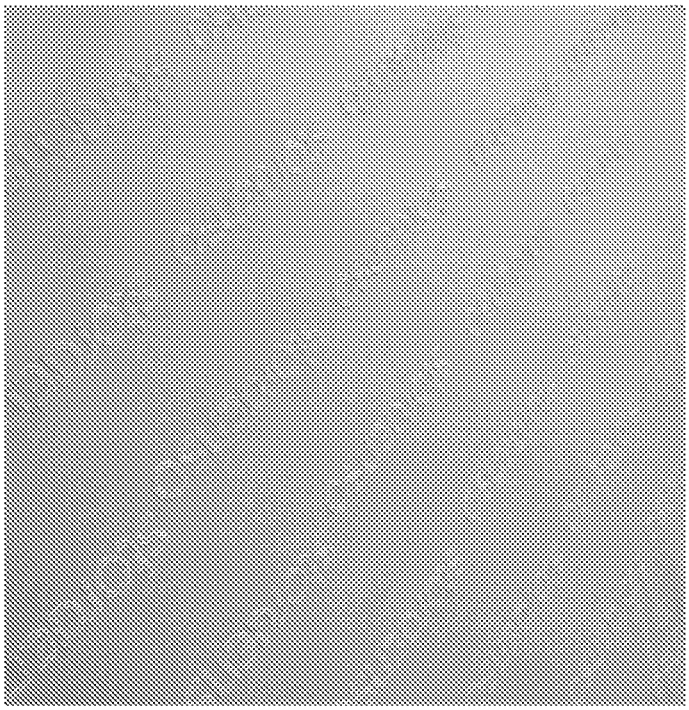
FIG. 2 is a photograph showing the increased height in the z-direction of the laser printed areas.

In FIG. 2 a sheet has been provided with a print comprising letters. The increased height of the material in the z-direction of the material, i.e. the swollen portions of the material can be clearly seen in FIG. 2.

In view of the above detailed description of the present invention, other modifications and variations will become apparent to those skilled in the art. However, it should be apparent that such other modifications and variations may be effected without departing from the spirit and scope of the invention.

The invention claimed is:

1. A method for printing a wet web material comprising microfibrillated cellulose, wherein said method comprises the steps of:

providing an aqueous suspension comprising microfibrillated cellulose;

applying said aqueous suspension to a substrate, thus forming a wet web having a moisture content in the range of 5 to 70 weight-%;

wherein the method further comprises the steps of:

treating said wet web by heating at least one well-defined portion thereof, whereby the web is provided with a print at the at least one heated portion; and, de-watering or drying the web, wherein the dried web has a density of 400-1500 $kg/m^3$.

2. The method as claimed in claim 1, wherein the dried web has a basis weight of less than 60 gsm.

3. The method as claimed in claim 1 wherein the substrate is a porous wire of a papermaking machine.

4. The method as claimed in claim 1, wherein the well defined portions comprises at least one of a figure and a letter.

5. The method as claimed in claim 1, wherein the heating is performed by using laser.

6. The method as claimed in claim 1, wherein the suspension comprises microfibrillated cellulose in an amount of 60-100 wt-% based on total dry solid content.

7. The method as claimed in claim 1, wherein the moisture content in the wet web is in the range of from 10 to 60 weight-%.

8. The method as claimed in claim 1, wherein the step of heating is performed in an in-line process step.

9. The method as claimed in claim 1, wherein the step of heating is performed in an off-line process step.

10. The method as claimed in claim 1, wherein the method further comprises a step of at least one of treating the surface of the web and coating the web.

11. The method as claimed in claim 1, wherein the moisture content in the wet web is in the range of from 20 to 50 weight-%.

12. The method as claimed in claim 1, wherein the moisture content in the wet web is in the range of from 25 to 45 weight-%.

13. A paper or paper product, comprising a web, obtained by the method of claim 1.

14. A method for printing a wet web material comprising microfibrillated cellulose, wherein said method comprises the steps of:

providing an aqueous suspension comprising microfibrillated cellulose, wherein the suspension comprises microfibrillated cellulose in an amount of 60-100 wt-% based on total dry solid content;

applying said aqueous suspension to a substrate, thus forming a wet web having a moisture content in the range of 5 to 70 weight-%; and, treating said wet web by heating at least one well-defined portion thereof, whereby the web is provided with a print at the at least one heated portion.

* * * * *